United States Patent [19]

Lazaro

[11] Patent Number: 5,030,330

[45] Date of Patent: Jul. 9, 1991

[54] ELECTROPLATING BARREL

[75] Inventor: Anton E. Lazaro, Park Ridge, Ill.

[73] Assignee: Hardwood Line Manufacturing Co., Chicago, Ill.

[21] Appl. No.: 542,104

[22] Filed: Jun. 22, 1990

[51] Int. Cl.[5] ..... C25D 5/00; C25D 17/18

[52] U.S. Cl. ..... 204/14.1; 204/213

[58] Field of Search ..... 204/14.1, 213

[56] References Cited

U.S. PATENT DOCUMENTS 4,740,286 4/1988 Lazaro ..... 204/213

4,749,461 6/1988 Lazaro ..... 204/213

OTHER PUBLICATIONS

Electroplating Engineering Handbook, edited by A. Kenneth Graham copyrighted 1955, pp. 479–480.

Belke Small Lot Plating Barrels with Chassis Mounted Drive, p. 14.

Hardwood Line Manufacturing Company brochure, Fushion Series 3 Plating Barrel.

*Primary Examiner*—T. M. Tufariello

*Attorney, Agent, or Firm*—Irwin C. Alter

[57] ABSTRACT

An improved, doorless, horizontal, perforated electroplating barrel which holds objects to be electroplated with cathode danglers when the barrel is rotated in one direction and upon reversal of the rotation of the electroplating barrel, the barrel empties itself. The improvement resides in the method of plating and design of the barrel that brings about an improved deposition of the electrolyte on parts so that when the parts are initially at a distance further removed from the cathode points, the electrical deposition is improved since the parts are caused to move to different zones in the barrel to be more proximately located for electrical contact with one of the cathode points during the plating operation. A deflector means is used in the barrel to cause a certain pattern to the tumbling parts in the barrel whereby parts initially loaded or dumped into the barrel contact the deflector means and are guided or forced inwardly toward the middle of the barrel so that when parts are internally dumped to a lower wall portion of the barrel they are deposited near the middle of the barrel, then, gradually, while the barrel is being rotated, the parts end up being moved and distributed through various zones in the barrel to bring about a better deposition by locating the parts closer to the danglers for better plating deposition. This provides a more even spread of distribution of the parts around the danglers or cathodes 37, 38.

7 Claims, 2 Drawing Sheets

ELECTROPLATING BARREL

BACKGROUND OF THE INVENTION

As illustrated, for example, in Lazaro, U.S. Pat. No. 3,421,993, as well as U.S. Pat. No. 4,740,286, electroplating barrels are well known for use in the electroplating of small objects. The typical electroplating barrel has a perforated wall and is immersed in electrolyte solution while containing objects to be electroplated. The barrel is then rotated so that the objects tumble within the barrel while submerged in the electrolyte solution and then an electrical potential is placed across the electrolyte solution in a conventional manner to cause electroplating of the objects to take place.

Processes of this type can require separate steps for loading and unloading parts from the electroplating barrel. Also, at various times, some barrels have devices for redistributing loads or they have to be stopped in order to redistribute the load being electroplated so that a better "spread" is achieved in order to obtain better electrical deposition of the electrolyte.

As previously mentioned in U.S. Pat. No. 4,740,286, the plating of small parts where the parts are not located with a good spread, or for instance, are stuck in a door, the parts will not become properly coated. Thus, where one or more clients can raise a significant suspicion that the entire lot of parts to be plated are not plated, the client or purchaser rejects the entire lot as being defectively plated.

Ideally, having an automatic reloading barrel which does not have a door that has to open and close, can eliminate the disadvantages of a door in that starting and stopping to undo the door during loading and unloading certainly takes time off the assembly line. However, unless the parts to be electroplated are distributed throughout the barrel with a good spread, the barrel still needs to be stopped in order to redistribute the load. Where the barrel has not been constructed in such a way that the load of parts is automatically distributed and redistributed throughout the barrel, an even deposition of electrolyte cannot be made without having to stop the barrel.

In accordance with the invention, an improvement in the design of a plating barrel, as well as a new process for plating parts in a plating barrel is provided wherein a doorless barrel, having novel deflector means extending from both of the ends of the barrel creates an improved process whereupon when the barrel is rotated, the parts to be plated are caused to be moved inwardly from the ends of the barrel to near to center of the barrel and gradually redistributed upon further revolutions of the barrel so that the parts move through various zones of the barrel. The moving parts enhance the deposition of electrolyte by having the parts or load directed from the outside to the center and then back again in repetition gradually back to the outside so that the entire load or entire group of parts is caused to come in contact or in close proximity to the cathode points to achieve a more even and uniform plating by having substantially the same amount of electrical charge on the electrolyte.

DESCRIPTION OF THE INVENTION

In this invention, a perforated, electroplating barrel for holding objects to be electroplated is doorless and access is gained to the interior through an access slot formed by panels having inner and outer overlapping ends that form a passageway for the parts to go to and from the interior of the barrel.

Obviously, the size of the access slot controls the size of the parts that can be plated in the barrel by means of limiting what parts can enter the barrel through this opening which is the only opening designed to receive a load of parts.

Deflector means extend from a panel wall of the barrel to the ends of the barrel so that once the parts are in the barrel, rotation of the barrel in a certain direction, called its plating mode direction (in this case clockwise), causes the parts at the ends of the barrel to be initially contacted by the deflector means and gradually forced or guided downward to the middle of the barrel for deposit at the center zone of the barrel. As the barrel is rotated, the parts are deposited or dumped on a lower panel of the barrel in a pattern that builds up at the center zone of the barrel and gradually flattens out toward the ends of the barrel, thereby causing improved deposition of electroplating material.

Thus, in addition to the new deflector means being provided with the automatically loading barrel, a new process is provided which includes the steps of having an automatic barrel loaded and thereafter causing the parts to be redistributed throughout the barrel while the barrel is rotating by means of initially forcing the parts inwardly toward the central zone from the ends and thereafter dumping or depositing the parts near the center of the barrel and causing them to gradually disperse outwardly towards the ends of the barrel as the barrel is rotated and the parts tumble and are dumped to a lower panel portion. This dumping process keeps recurring as rotation of the plating barrel rotates through many revolutions, thereby repeating the process of inward and outward dispersion until parts are electroplated, whereupon the barrel is stopped and caused to rotate in the other direction for purposes of unloading the parts.

As seen from pages 479 and 480 of Electroplating Engineering Handbook, edited by A. Kenneth Graham, copyrighted 1955, automatically loading, doorless barrels have been made before; however, there are none that employ the deflection means or the novel process of dispersing parts for more efficient plating a disclosed herein.

DESCRIPTION OF A SPECIFIC EMBODIMENT

Figure 1:
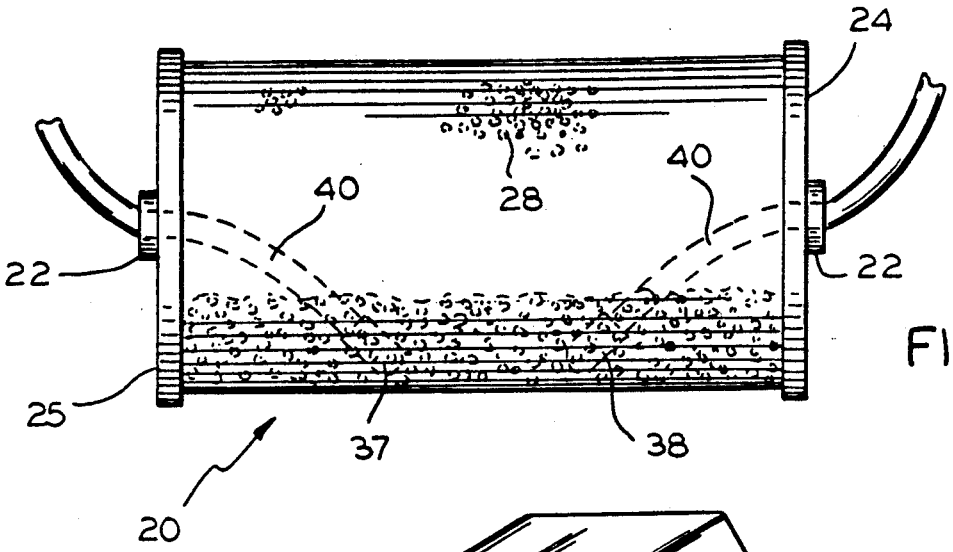
FIG. 1 is a side elevational view of the conventional plating barrel illustrating parts that are to be plated by the plating barrel.

Referring to the drawings, electroplating barrel 20 is shown as rotatably driven and it is journalled by means of bearing members 22 that are disposed in the center of the end plates 24, 25 and are rotatably driven by means of power such as a motor and gears (not shown) as seen in U.S. Pat. No. 4,740,286 as well as any number of previously built electroplating barrels. Generally, the electroplating barrels reside in a bath of electrolyte solution of conventional design so as to permit the interior of the barrel 20 to be substantially filled with such solution, the solution passing into barrel 20 through the perforations 28 in the panels 30*a*, 30*b*, 30*c*, 30*d*, 30*e*, 30*f*, 30*g*, 30*h* and 30*i* of the barrel. An electrical potential is applied to the parts loaded in the barrel by means of the cathode points 37, 38 which are accessed to the barrel by means of insulated conductors that protrude through the bearing members 22 of the end plates 24 and 25 and are connected to electrical power generating means in accordance with known ways for providing electroplating action to articles within the barrel 20.

The barrel 20 is doorless and has novel deflector means 42, 43 extending on an incline from both end plates 24, 25 of the barrel 20 to a panel 30*f* of the barrel near to the center zone of the barrel to create a means of directing or funneling the parts to be plated to the center zone of the barrel.

Figure 2:
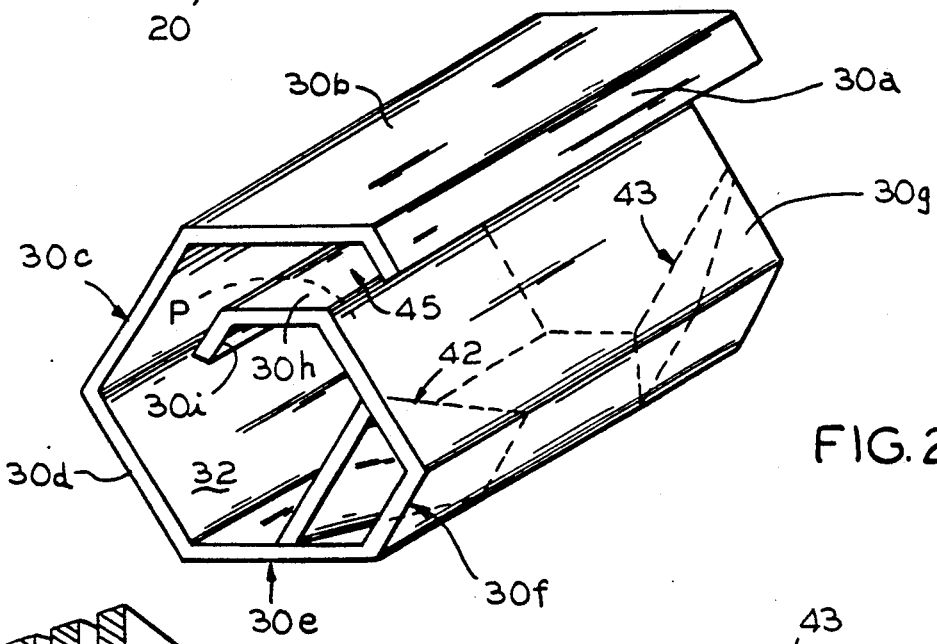
FIG. 2 is a pictorial view of a portion of the plating barrel constructed in accordance with this invention.
Figure 2A:
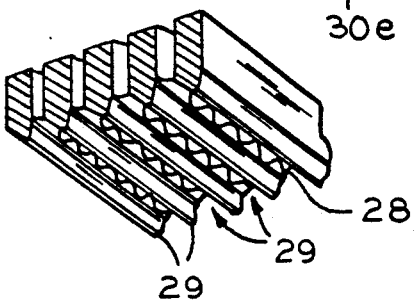
FIG. 2A is a detailed view taken from the interior of the barrel showing the striations of the barrel with perforations.
Figure 3:
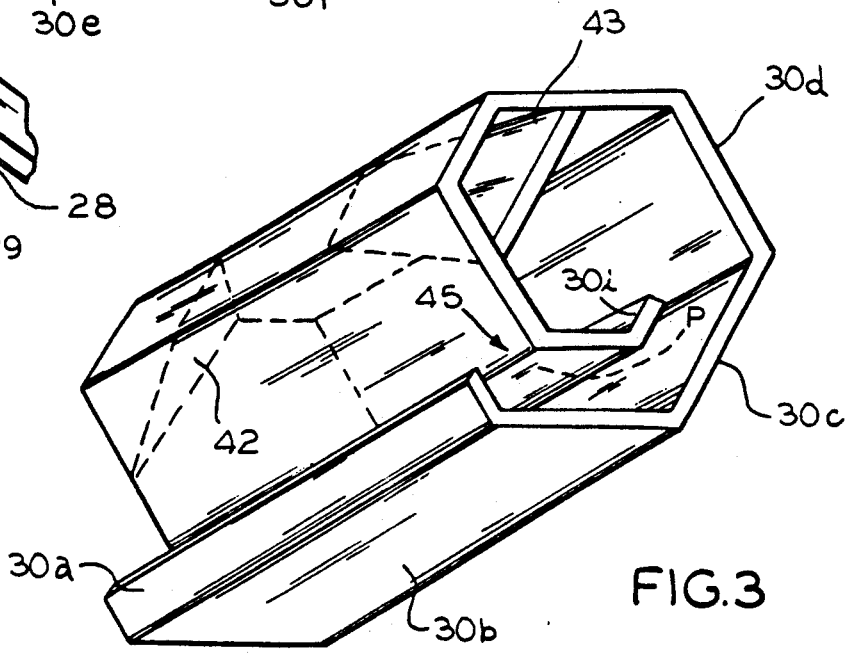
FIG. 3 is a pictorial view of a portion of the plating barrel in a rotated position showing the deflector means, in phantom.

The barrel can be loaded by putting the parts to be plated into the barrel through the barrel's access slot 45 and a passageway P which is formed by the inner and outer overlapping ends of the panels 30*a*, 30*b*, 30*c* (outer end) and 30*g*, 30*h* and 30*i* (inner end). Note, for best operation that the panels 30*a* and 30*i* should be solid, non-perforated since this prevents the parts from stacking up. Also, by forming the striations 29 on all the panels except 30*a* and 30*i*, it has been found that parts do not get lodged so easily in the barrel. In FIG. 2A, which is a detail of the barrel structure from the interior looking at the striations 29, it can be seen that the striations form a trough 29*a* with the perforations 28 at the bottom thereof. This enables better drainage of the barrel.

Figure 4:
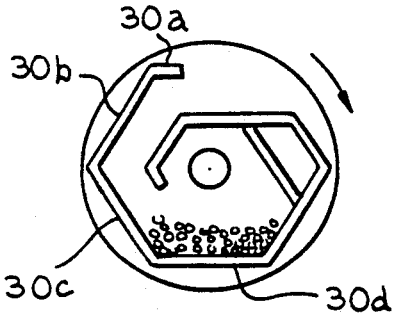
FIG. 4 is a half-sectional end view of the plating barrel loaded with parts, the barrel being in its loading mode.
Figure 5:
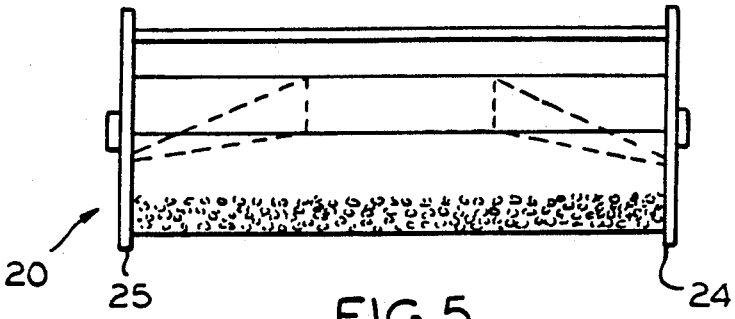
FIG. 5 is a side elevational view of a portion of the plating barrel illustrating the parts in the barrel after having been loaded.
Figure 6:
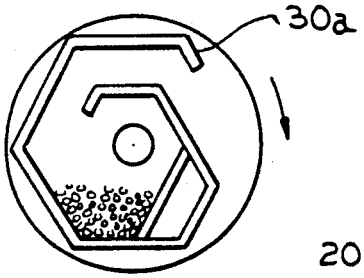
FIGS. 6, 8 and 10 are similar views to FIG. 4 with the barrel in its plating mode being rotated in a clockwise direction.
Figure 7:
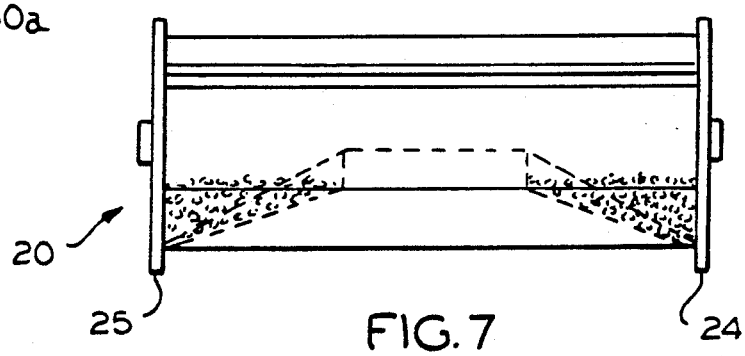
FIGS. 7, 9 and 11 are similar views to FIG. 5 with the barrel rotated clockwise and corresponding serially to the views in FIGS. 6, 8 and 10, respectively.
Figure 8:
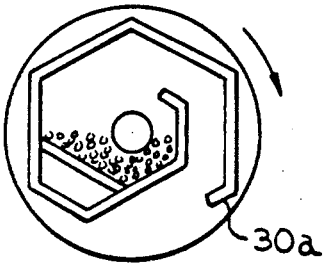
Figure 9:
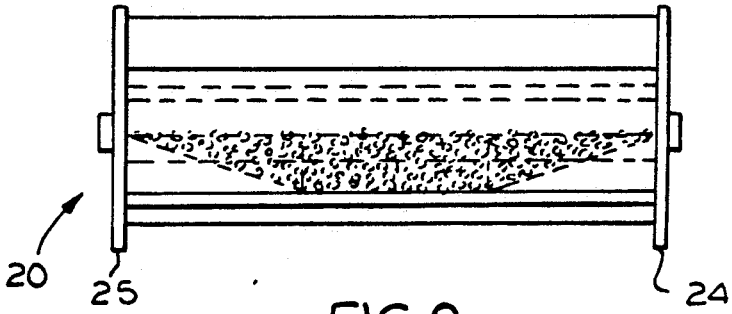
Figure 10:
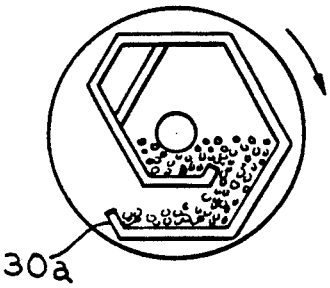
Figure 11:
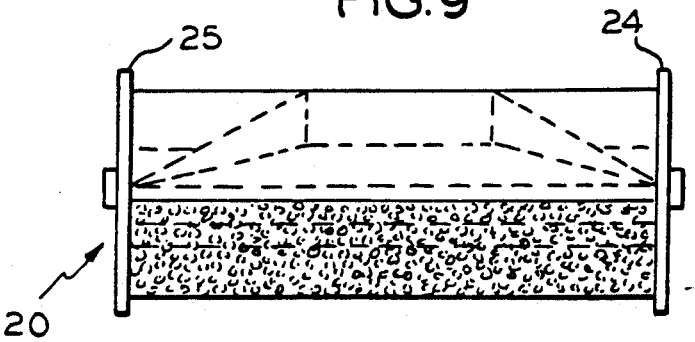

As seen in FIGS. 4 and 5, the barrel is in its loading mode and has just had parts deposited in same. Thus, as the barrel is moved clockwise during its plating mode, the parts are funnelled or directed to the center zone of 30*f* as seen in FIGS. 8 and 9. After the parts are directed to the center zone, as seen in FIGS. 8 and 9, they are eventually deposited or dumped on lower panels of the barrel 30*g*, 30*h* and 30*i* as seen in FIG. 10 in a pattern that builds up at the center zone of the barrel so that when the barrel continues rotating, the parts achieve a better distribution along the barrel by being re-circulated through the barrel as it continues rotating clockwise in its plating mode. As seen from FIG. 10, the inner overlapping end 30*i* has the parts overflowing so that they are dumped to lower panels which, in the case of FIG. 10, are the panels 30*b* and 30*c* of the outer overlapping end of the panels. As the barrel rotates, it gradually flattens out the pattern of the parts and thereafter, when a deflector means initially comes in contact with the parts at the ends of the barrel, they deflect or funnel the parts in toward the center zone of the barrel to repeat the cycle. When it is desired to unload the barrel, the direction of rotation is reversed to a direction opposite its plating mode (counterclockwise), whereupon the parts can be dumped or unloaded through the access slot. The access slot 45 will not ordinarily allow parts to escape unless the barrel is rotated in a counterclockwise direction since the speed of the clockwise rotation and the shape of the slot is sufficient to contain the parts during the plating mode.

In describing the operation of the new and improved barrel design, it can be seen that a new and improved process has been obtained in that when the barrel is rotating in the plating mode, the parts to be plated are caused to gradually be moved through different zones of the barrel from the ends of the barrel toward the center zone of the barrel and back again so that the parts are more completely electroplated. The improved process includes the steps of loading the particular barrel described, causing the parts to be redistributed throughout the barrel while the barrel is rotating in its plating mode by inclined deflector means forcing the parts inwardly and thereafter dumping or depositing the parts near the center zone of the barrel on the lower panels of the barrel and causing the parts to gradually disperse outward towards the end of the barrel, as the barrel is rotated and the parts are caused to be dumped to a lower panels. Thereafter, the process includes repeating inward and outward dispersion of the parts through different zones of the barrel until the parts are electroplated, and then stopping and reversing the rotation of the barrel for purposes of unloading the parts.

The above has been offered for illustrative purposes for ease of understanding and explaining the principles upon which the invention operates only and is not intended to limit the scope of the invention of this application which is defined in the claims below.

What is claimed is:

1. In a doorless electroplating barrel which comprises a rotatable, perforated barrel defined with panels extending between end plates, said barrel being suitable for holding parts to be electroplated, said barrel having an access slot for loading and unloading parts into and from its interior, means for imposing an electrical potential across electrolytic solution within said barrel, said barrel having a center zone and a pair of end zones at each end thereof, the improvement comprising in combination:

said panels having inner and outer overlapping ends that define a passageway for said parts to go in and out of said barrel through said access slot, said outer overlapping end being disposed on the outside of said barrel, while said inner overlapping end being disposed on the inside of said barrel, deflector means formed on the inside of said barrel to cause said parts deposited in said barrel to be funneled from each of the end zones of said barrel to the central zone of said barrel upon rotation in one direction of said barrel in the plating mode, some of said parts being caused to gradually drop off from said inner overlapping end inside said barrel onto a barrel panel disposed below during each cycle of revolution of said barrel, said outer overlapping end being formed and disposed to retain parts inside said barrel when said barrel is rotating in its plating mode but being formed to enable parts to be dumped when said barrel is rotated in an opposite direction from said plating mode in its unloading mode, whereby said deflector means causing said parts to gradually be recirculated around said barrel during its plating mode by funneling parts from the end zones of said barrel to the central zone of said barrel and causing said parts to be dumped from said inner overlapping panel end onto the center of the panels below said inner overlapping panel end to achieve more efficient electrical deposition on the parts during the plating mode.

2. A plating barrel, as defined in claim 1 wherein said deflector means extends from at least one of said panels and said end plates to act as a funnel in causing the parts to be gradually moved toward the central zone of the barrel from the ends thereof upon each revolution of said barrel in the plating mode.

3. A plating barrel, as defined in claim 1, wherein the deflector means are at least a pair of deflector means with each extending from one of said panels and said end plates.

4. A plating barrel, as defined in claim 1, wherein striations with perforations are formed at the bottom thereof.

5. An improved process concerning a doorless perforated electroplating barrel for holding parts to be electroplated, said barrel having means for imposing an electrical potential across electrolytic solution within said barrel, and access slot means for loading and unloading parts, said barrel retaining parts loaded in it when rotated in the direction of its electroplating mode and unloading parts contained therein when rotated in its dumping mode, positioning the barrel into its load mode;

placing parts to be electroplated in the access slot thereof, rotatably driving said barrel in the plating mode direction, causing said parts to be plated to move from the ends of the barrel to the central section of the barrel upon rotation during said plating mode, causing said parts to be gradually redistributed throughout the barrel by redistributing said parts deposited in the middle of the barrel upon further rotation of the barrel in said plating mode, repeating the process of causing said parts to move from the ends of the barrel to the middle of said barrel and back to the ends of the barrel, whereby the parts are caused to come in close proximity to cathode points to achieve a more even and uniform plating by imposing an even amount of electrical charge on the electrolyte.

6. An improved process wherein the barrel has panels with an outer free end and an inner free end to define a passageway for parts to and from the inside of the barrel comprising the further step of:

dumping the parts after they have been funnelled to the inner free end of the panels by having the parts overflow and drop to a lower panel at the center zone of the barrel.

7. An improved process of claim 6 wherein said inner free end is V-shaped to cause the earliest dumping of parts on said lower panel.

* * * * *